United States Patent [19]

Tardiff

[11] 4,247,027

[45] Jan. 27, 1981

[54] BOW-MOUNTED QUIVER

[75] Inventor: George E. Tardiff, Wayne, N.J.

[73] Assignee: Mooney Brothers, Little Falls, N.J.

[21] Appl. No.: 40,123

[22] Filed: May 18, 1979

[51] Int. Cl.[3] ..... B65D 71/00

[52] U.S. Cl. ..... 224/197; 124/24 A; 124/45

[58] Field of Search ..... 124/23 R, 23 A, 24 R, 124/24 A, 88, 45, 48; 224/916, 197

[56] References Cited

U.S. PATENT DOCUMENTS 3,017,874 1/1962 Gubash ..... 124/23 A

*Primary Examiner*—Richard C. Pinkham
*Assistant Examiner*—William R. Browne
*Attorney, Agent, or Firm*—Samuelson & Jacob

[57] ABSTRACT

A quiver includes a frame releasably holding arrows and mounted on a bow for movement between a storage position, in which the arrows are disposed parallel to the bow, and a nocking position, in which the arrows are placed across the bow and the bowstring thereof. The frame carries a drive member which extends axially at an acute angle to the bow, and the drive member is driven by an actuator through simultaneous axial and rotational motion to move the frame from the storage position to the nocking position.

12 Claims, 6 Drawing Figures

BOW-MOUNTED QUIVER

The present invention relates generally to archery and pertains, more specifically, to a quiver which is to be mounted on a bow for storing arrows and selectively locating the stored arrows in position, relative to the bow and the bowstring thereof, for nocking.

A recent increase in the popularity of bow hunting has led to a demand for more effective and convenient archery equipment. It has been suggested that bow hunting would be more productive through the use of a bow-mounted quiver which not only conveniently stores extra arrows, but quickly places the stored arrows in position for nocking so that an archer can have available a subsequent arrow in place for shooting very soon after a previous arrow leaves the bow. In this manner, the archer is given a chance for a second shot at a target at about the same time that the arrow from a first shot strikes the target.

Bow quivers which are mounted on a bow for storing arrows in a convenient location have been available for some time. Automatic bow quivers which automatically place a second arrow in nocking position in response to the shooting of a first arrow have been suggested in the prior art.

It is an object of the present invention to provide a bow quiver which stores arrows conveniently on a bow and which selectively places the stored arrows in nocking position, across the bow and bowstring.

Another object of the invention is to provide a bow quiver in which an arrow-holding frame, capable of holding a plurality of arrows, is mounted upon a bow for movement, by selective manual actuation, between an arrow storage position and an arrow nocking position.

Yet another object of the invention is to provide a bow quiver of the type described and in which the arrow storage position is located to one side of the bow, opposite to the side where an arrow is to be nocked, and out of the line of sight of the archer as the archer takes aim at a target, yet the stored arrows may be placed quickly and conveniently in the nocking position.

Another object of the invention is to provide a bow quiver of the type described and which is lightweight, compact, and mounted for maintaining the bow and quiver in appropriate balance.

Still another object of the invention is to provide a bow quiver of the type described and in which the mechanism for moving the stored arrows between the storage position and the nocking position is simple, yet effective, and reliable in use in the field.

A further object of the invention is to provide a bow quiver of the type described and in which the stored arrows are held in a storage frame which is moved simultaneously through translational and rotational movements between the arrow storage position and the arrow nocking position for simplified rapid, accurate and reliable selective operation.

A still further object of the invention is to provide a bow quiver of the type described and in which the arrow storage frame is biased by gravity into the storage position and is positively secured in that position for safety.

Yet a further object of the invention is to provide a bow quiver of the type described which is fabricated economically of a minimum number of simple component parts readily assembled into a rugged mechanism capable of effective and reliable operation over a long service life.

The above objects, as well as still further objects and advantages, are attained by the present invention which may be described briefly as a quiver for use in connection with a bow for storing arrows and selectively locating the stored arrows in position, relative to the bow and the bowstring thereof, for nocking, the quiver comprising: a frame; holding means on the frame for releasably holding the arrows in a generally parallel array with the arrows extending in a prescribed alignment within the frame; a drive member carried by the frame, the drive member extending along a longitudinal axis making an acute angle with the prescribed alignment; mounting means for attachment to the bow and receiving the drive member so as to support the frame for movement between a storage position, wherein the arrows extend in a first direction generally parallel to the bow and bowstring, and a nocking position, wherein the arrows extend in a second direction across the bow and bowstring; coupling means coupling the drive member and the mounting means with the longitudinal axis of the drive member extending in a third direction angularly intermediate the first and second directions, so that the coupling means enables movement of the drive member simultaneously axially in the third direction and rotationally about the longitudinal axis thereof relative to the mounting means for moving the frame between the storage position and the nocking position; and actuating means for selectively driving the drive member through the simultaneous axial and rotational movement to move the frame from the storage position to the nocking position.

The invention will be understood more fully, while still further objects and advantages will become apparent, in the following detailed description of a preferred embodiment thereof illustrated in the accompanying drawing, in which.

Figure 1:
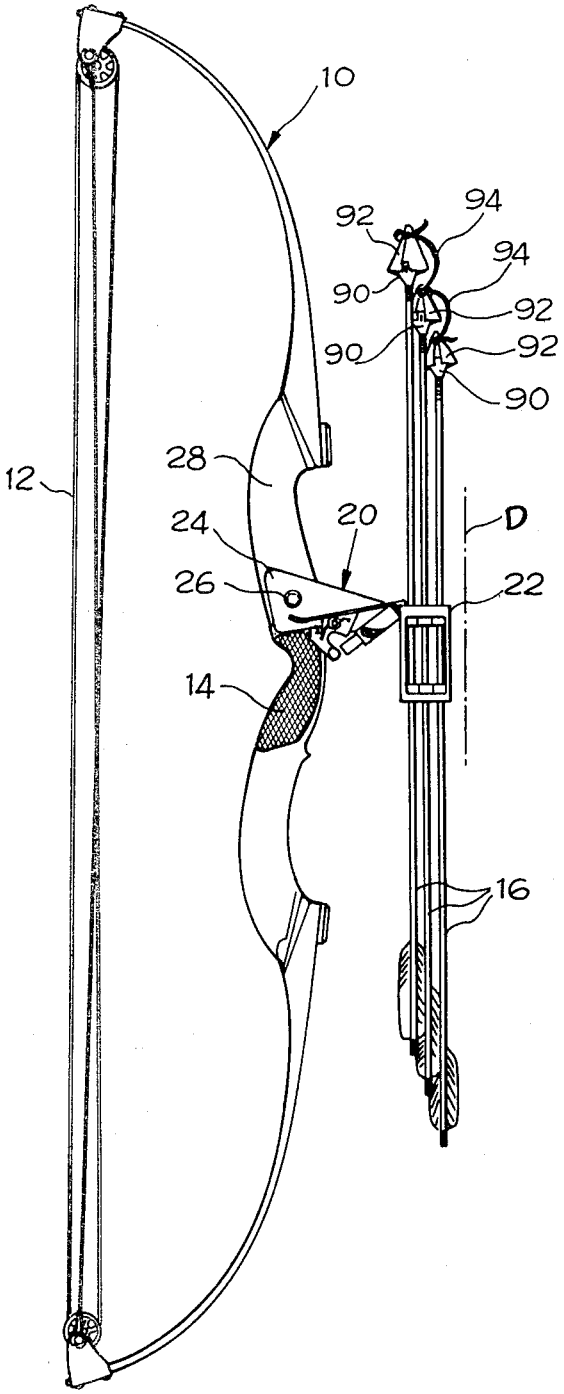
FIG. 1 is a side elevational view of a bow with a quiver constructed in accordance with the invention.
Figure 2:
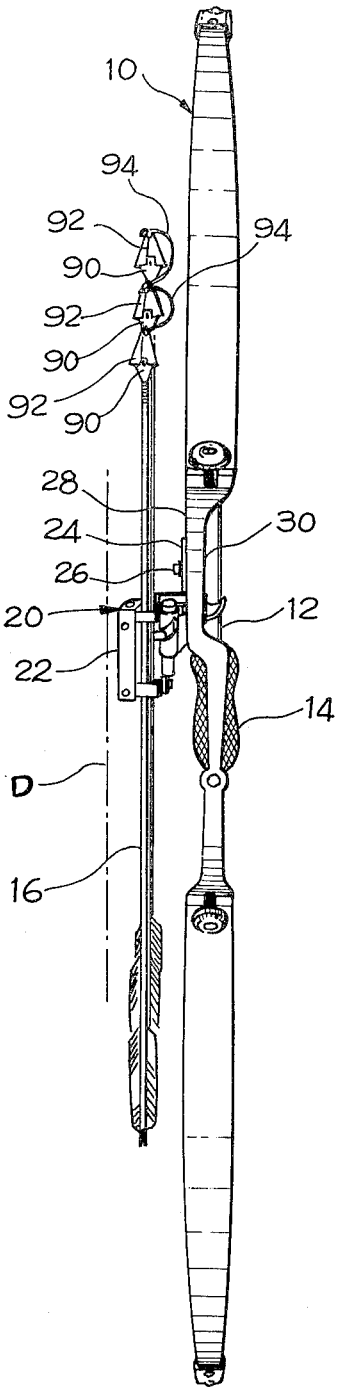
FIG. 2 is a front elevational view of the bow of FIG. 1.

Referring now to the drawing, and especially to FIGS. 1 and 2 thereof, a conventional bow is shown at 10 and is seen to have a bowstring 12 and a hand grip 14. A plurality of arrows, in this instance three arrows 16, are stored in quiver 20 which is constructed in accordance with the invention. Quiver 20 is mounted upon bow 10 adjacent hand grip 14, and arrows 16 are depicted in a stored position, in a generally parallel array.

Quiver 20 includes a frame 22 within which arrows 16 are held in fixed alignment, relative to frame 22, the fixed alignment being defined by holding means which will be explained in greater detail below. Frame 22 is carried by a mounting plate 24 which is affixed to bow 10 by a bolt 26 which passes through the mounting plate 24 and enters the bow 10 adjacent the hand grip 14. In the storage position of the frame, as depicted in FIGS. 1 and 2, the frame is oriented so that the arrows are aligned in a first direction D, extending generally parallel to the bow 10 and bowstring 12, and are spaced laterally from one side 28 of the bow 10, side 28 being opposite the side 30 against which arrows are placed for nocking and subsequent shooting, as will be explained hereinafter.

Figure 3:
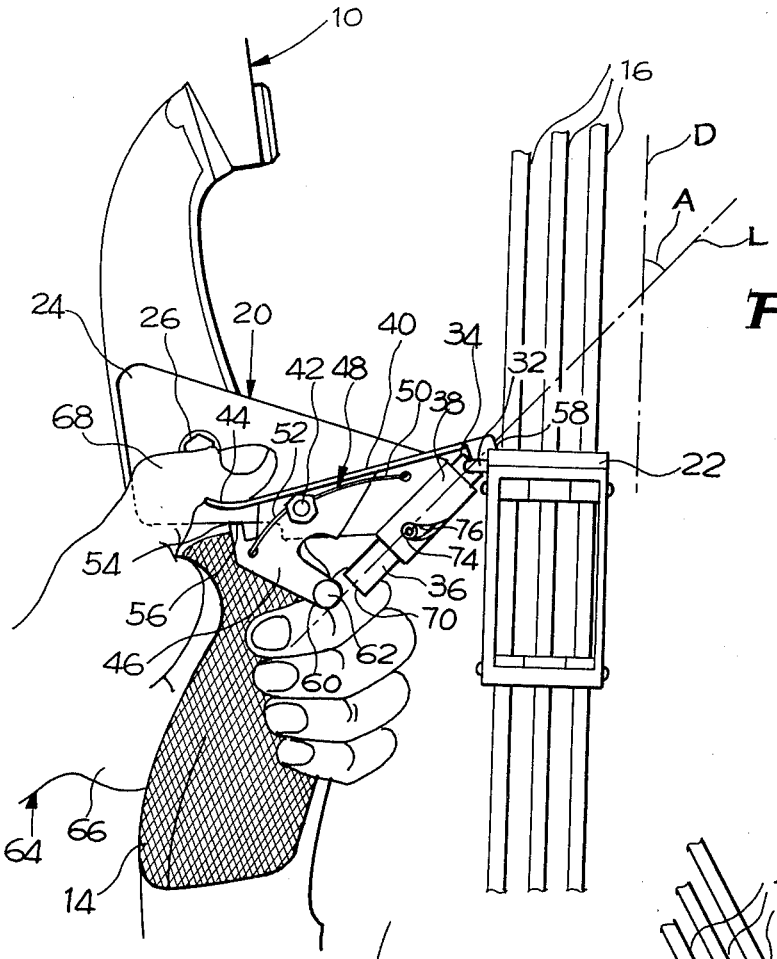
FIG. 3 is an enlarged fragmentary side elevational view showing the component parts of the quiver in a first position.
Figure 4:
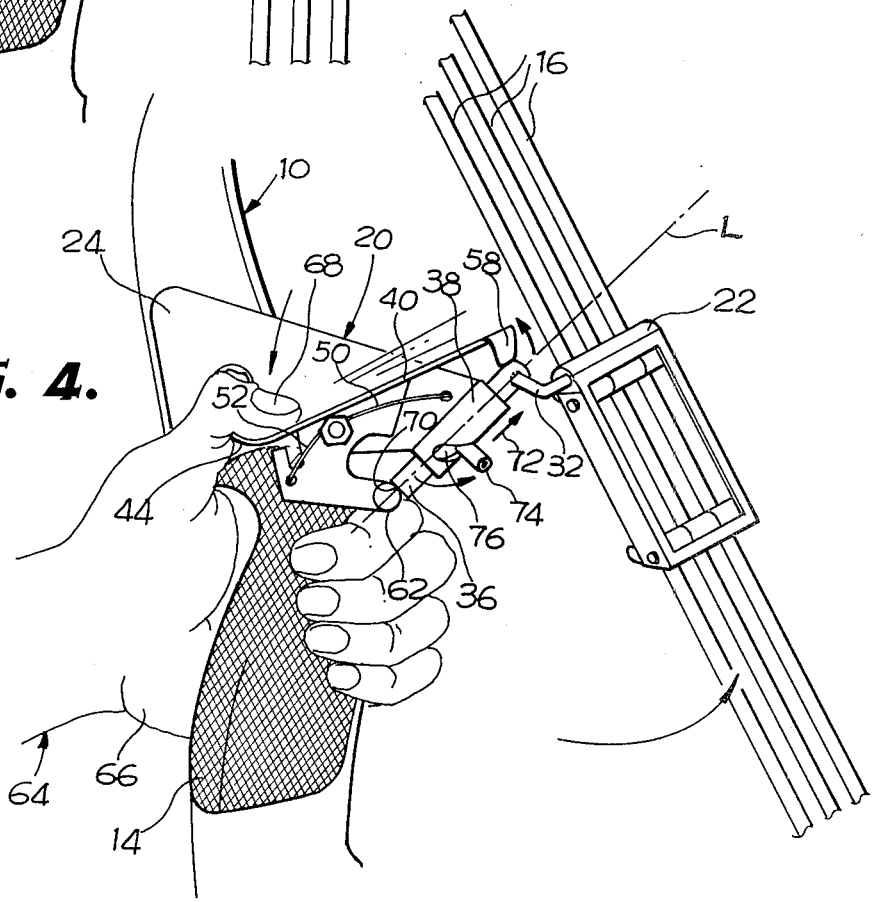
FIG. 4 is an enlarged fragmentary side elevational view showing the component parts of the quiver in another position.
Figure 5:
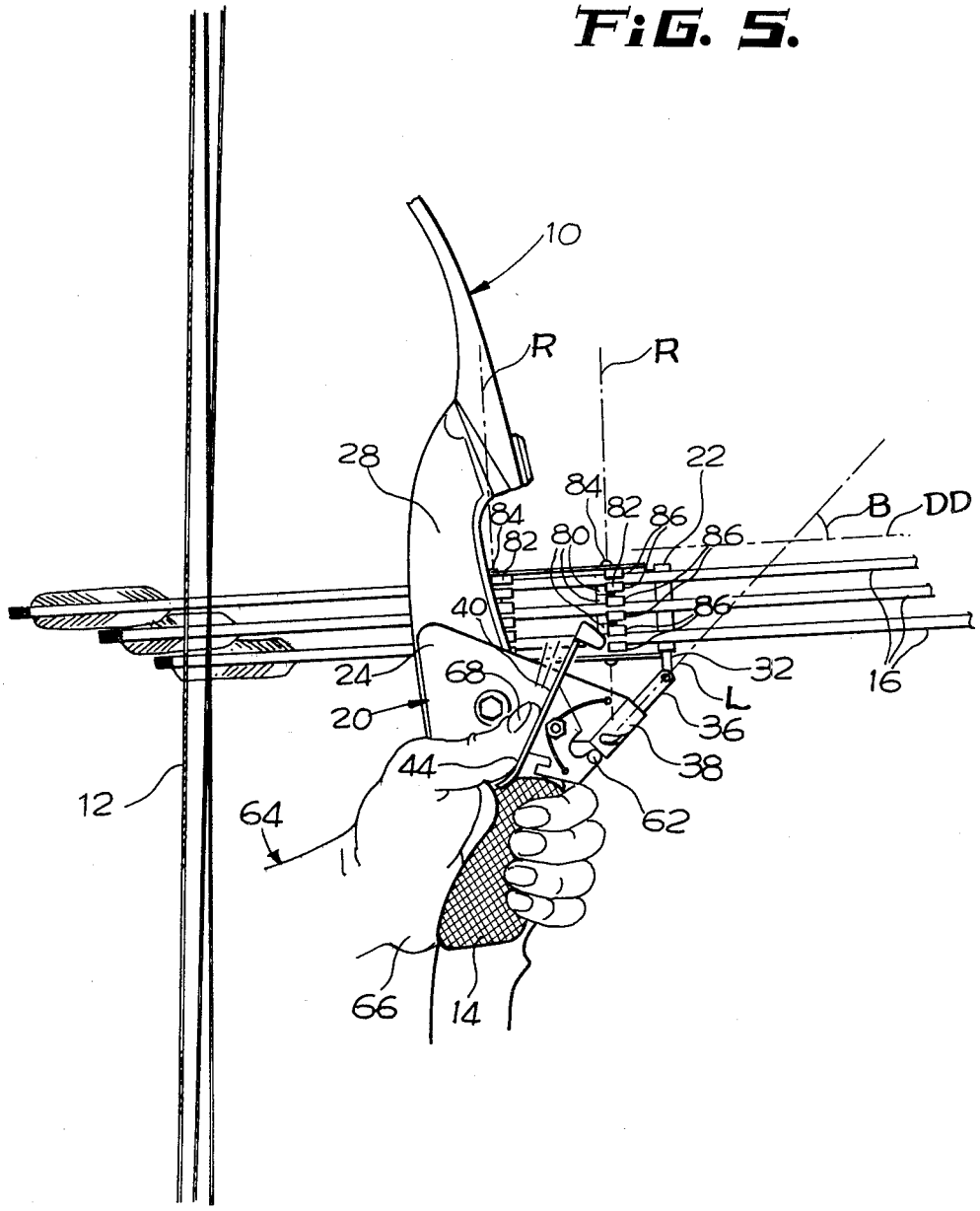
FIG. 5 is a further enlarged fragmentary side elevational view showing the component parts of the quiver in still another position.

As best seen in FIGS. 3 through 5, frame 22 of quiver 20 carries an arm 32 rigidly affixed thereto. Arm 32 is attached to one end 34 of a drive member shown in the form of a cylindrical drive rod 36 received within a cylindrical sleeve 38 which is integral with mounting plate 24. Drive rod 36 extends along a longitudinal axis L which makes an acute angle A with the first direction D of the alignment of the arrows 16 held in frame 22. Preferably, angle A is 45°.

Actuating means is shown in the form of a lever 40 mounted upon mounting plate 24 at spindle 42 for pivotal movement relative to the mounting plate 24 between a rest position, as seen in FIG. 3, and a depressed position, as seen in FIG. 5. Lever 40 includes a thumb bar 44 at one end thereof and a depending unitary web 46. A spring 48 is wrapped around spindle 42 and has a first leg 50 engaging the mounting plate 24 and a second leg 52 engaging the web 46 for biasing the lever 40 toward the rest position. A stop 54 on the web 46 engages an edge portion 56 of the mounting plate 24 to locate the lever 40 at the rest position. A latch 58 at the other end of the lever 40 engages arm 32 and secures the frame 24 at the storage position when the lever 40 is in the rest position.

Web 46 includes an abutment 60 which carries a wear-resistant bearing member 62. When it is desired to move an arrow 16 from storage into position for nocking, the archer 64, whose hand 66 grips the hand grip 14, places his thumb 68 upon the thumb bar 44 of lever 40, as seen in FIG. 3, and manually depresses the lever 40, as seen in FIG. 4. Pivotal movement of lever 40 from the rest position toward the depressed position disengages latch 58 from arm 32. At the same time, bearing member 62 is engaged with the other end 70 of the drive rod 36 and moves the drive rod 36 axially along longitudinal axis L in the direction of arrow 72. Drive rod 36 is coupled with sleeve 38 by means of a drive pin 74 which extends radially from drive rod 36 and passes through a helical slot 76 in the sleeve 38 so that axial translational motion of drive rod 36 as the drive rod 36 slides within sleeve 38 is accompanied by simultaneous rotational motion about axis L through 180° of rotation by virtue of the drive pin 74 following helical slot 76. The simultaneous translation and rotation moves frame 22, and the arrows 16 therein, away from the storage position, as seen in FIG. 4.

Turning now to FIG. 5, when the lever 40 is fully depressed and arrives at the depressed position shown, frame 22 is located at a nocking position; that is, frame 22 is oriented so that arrows 16 are placed against side 30 of the bow 10 with the arrows aligned in a second direction DD transverse to the first direction D so as to extend across the bow 10 and bowstring 12. Thus, the translation, in a direction angularly intermediate the first direction D and the second direction DD, and simultaneous rotation of the drive rod 36 through 180° results in concomitant translation and rotation of frame 22 to locate arrows 16 in position for nocking.

Figure 6:
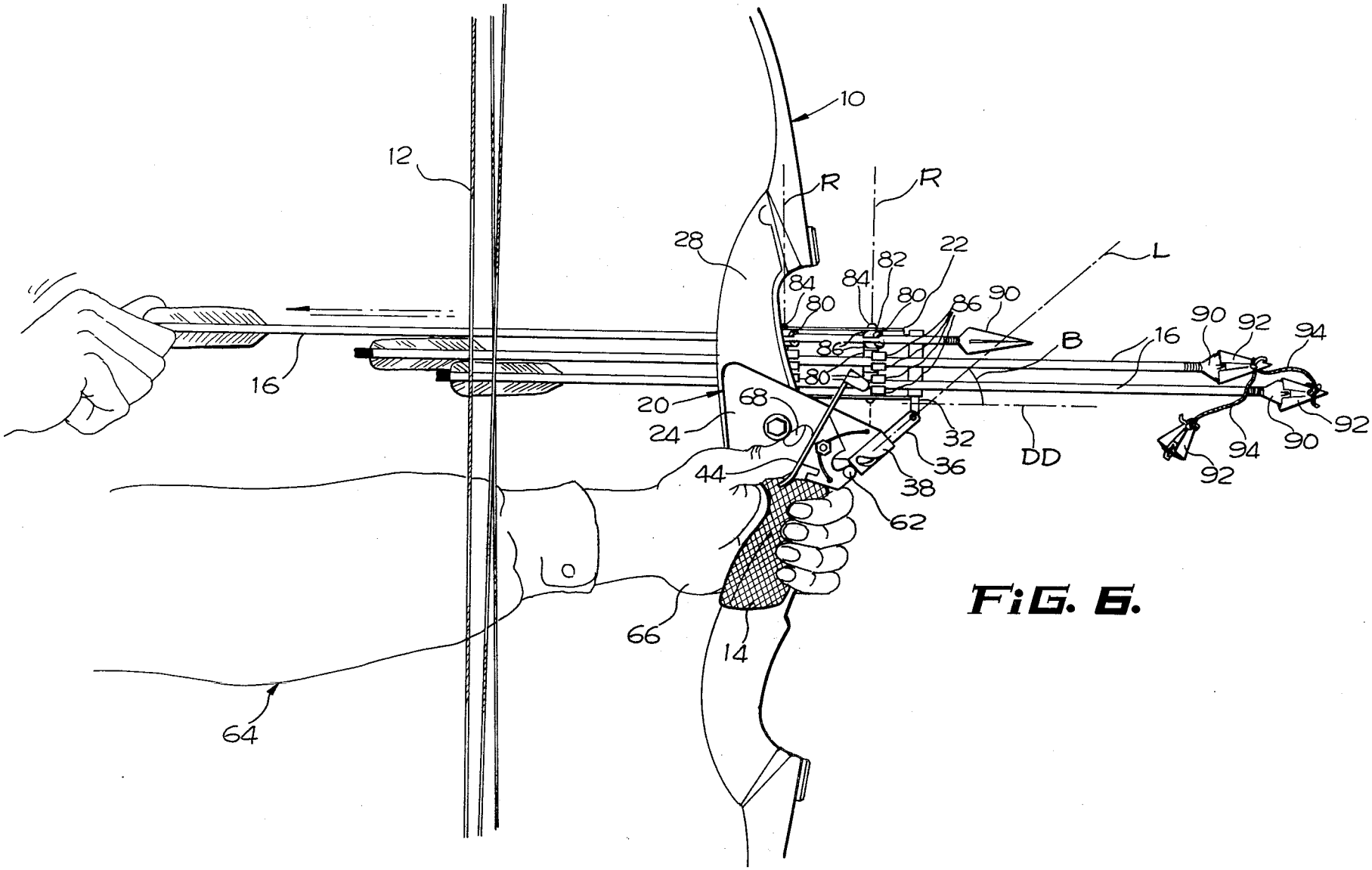
FIG. 6 is a side elevational view of the bow and quiver with an arrow being released from the quiver for nocking.

Referring now to FIG. 6, as well as to FIG. 5, arrows 16 are held in frame 22 by resilient clips 80 located in two rows 82 on frame 22. Clips 80 are constructed of a material which resiliently grips the arrows 16 with a prescribed frictional force. Preferably, clips 80 are molded of an elastomer. Each clip 80 in a row 82 is journalled upon a shaft 84 passing through the clips 80 and the frame 22. The axis of rotation R of the clips 80 on each shaft 84 is offset rearwardly (to the left, as viewed in FIGS. 5 and 6) of the fingers 86 of the clips 80 so that as an arrow 16 is pulled rearwardly, as seen in FIG. 6, the clips 80 holding that arrow 16 will rotate, by virtue of the frictional force between the clips 80 and the arrow 16, and the offset will pull the clips 80 from the arrow 16 to release the arrow for nocking.

It is noted that the arrows 16 in the parallel array in frame 22 are staggered so that the uppermost arrow, as viewed in FIGS. 5 and 6, is located readily by the archer without the need to take his eyes off the target. In addition, the arrows 16 are oriented in frame 22 so that the cock feather is appropriately located for nocking and shooting without reorienting the arrow. As a safety measure, the tips 90 of the arrows 16 are sheathed in individual sheaths 92 tied together by a cord 94. Upon pulling the uppermost arrow 16, the sheaths 92 on the remaining arrows 16, acting together with cord 94, will enable the uppermost sheath 92 to be stripped from the tip 90 of the uppermost arrow 16 as the arrow is pulled rearwardly. Thus, the safety sheath 94 is removed quickly without requiring any added manipulations.

Once the uppermost arrow 16 is grasped and released for nocking, as described above, lever 40 is released. The grasped arrow is then nocked and ready for shooting. Since the bow 10, when in the shooting position, is oriented generally vertically, the direction D becomes generally vertical, the direction DD becomes generally horizontal and the alignment of drive rod 36 and sleeve 38 is such that the drive rod 36 and sleeve 38 are inclined upwardly at an angle B. The angle of inclination is sufficient to assure that frame 22 is biased by gravity from the nocking position back to the storage position. An angle of inclination of about 45° will assure that frame 22 will be rotated and translated back to the storage position, by gravity, upon the release of lever 40. Once returned, the frame 22 will be secured in the storage position by latch 58. Since, in the storage position, the frame 22 is located adjacent to and spaced away from side 28 of bow 10, opposite to the side 30 against which a nocked arrow is placed, the frame 22, and the arrows therein, are out of the line of sight of the archer as he aims at a target.

It will be apparent, then, that quiver 20 provides means by which arrows can be stored conveniently on a bow and can be moved selectively into nocking position quickly and with ease and precision. The movement is so quick and convenient that an archer easily can set up for a subseqent shot even as the previous shot reaches its target. The quiver 20 is very compact and is arranged so as to be unobtrusive when mounted on a bow. The component parts are simple and the assembly is light in weight and so located as to maintain the appropriate balance in connection with the bow. The relationship among the component parts enables ease of manual operation, and a positive return to the normal rest and storage position is attained by the force of gravity. Thus, a simple yet effective device is provided for the enhancement of bow hunting.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A quiver for use in connection with a bow for storing arrows and selectively locating such stored arrows in position, relative to the bow and the bowstring thereof, for nocking, said quiver comprising:

a frame;

holding means on the frame for releasably holding stored arrows in a generally parallel array, said holding means defining a fixed alignment along which stored arrows will extend relative to the frame when held in the frame by the holding means;

a drive member carried by the frame such that the drive member extends along a longitudinal axis making an acute angle with the fixed alignment defined by the holding means;

mounting means adapted for attachment to a bow for receiving the drive member so as to support the frame for movement between a storage position, wherein the frame is oriented so that the fixed alignment extends in a first direction which is generally parallel to the bow and the bowstring thereof, when the mounting means is attached to the bow, and a nocking position, wherein the frame is oriented so that the fixed alignment extends in a second direction transverse to the first direction so as to extend across the bow and the bowstring thereof, when the mounting means is attached to the bow;

coupling means coupling the drive member and the mounting means, with the longitudinal axis of the drive member extending in a third direction located angularly intermediate said first and second directions, so that the coupling means enables movement of the drive member simultaneously axially in said third direction and rotationally about the longitudinal axis thereof relative to the mounting means for moving the frame between the storage position and the nocking position; and actuating means for selectively driving the drive member through the simultaneous axial and rotational movement to move the frame from the storage position to the nocking position.

2. The invention of claim 1 wherein the first direction is generally vertical and the second direction is generally horizontal when the mounting means is attached to a bow which is aligned in a generally vertical shooting position, the third direction being inclined upwardly at an angle of inclination to establish a gravity biasing force sufficient to return the frame from the nocking position to the storage position.

3. The invention of claim 2 wherein said angle of inclination is about 45°.

4. The invention of claim 1, 2 or 3 wherein the rotational movement of the drive member is about 180° to move the frame between the storage position and the nocking position, such that upon attachment of the mounting means to a bow having opposite sides, the frame will be moved from one to the other of the opposite sides of the bow.

5. The invention of claim 4 including a latch for securing the frame in the storage position, said latch being associated with the actuating means for release upon operation of the actuating means to drive the drive member through said axial and rotational movement.

6. The invention of claim 1 wherein:

the drive member comprises a cylindrical drive rod having axially opposite first and second ends;

the mounting means includes an axially extending cylindrical sleeve for receiving the drive rod;

the coupling means includes a helical slot in the sleeve and a drive pin carried by the drive rod and extending radially therefrom; and the drive rod is placed within the sleeve with the drive pin engaged within the slot such that axial movement of the rod within the sleeve will result in simultaneous rotational movement by virtue of the drive pin following the helical slot.

7. The invention of claim 6 wherein the actuating means includes:

a lever mounted upon the the mounting means for pivotal movement relative to the mounting means between a rest position and a depressed position;

abutment means on the lever for engaging the first end of the drive rod to move the drive rod in response to movement of the lever from the rest position toward the depressed position; and biasing means for biasing the lever toward the rest position.

8. The invention of claim 7 wherein the first direction is generally vertical and the second direction is generally horizontal when the mounting means is attached to a bow which is aligned in a generally vertical shooting position, the third direction being inclined upwardly at an angle of inclination to establish a gravity biasing force sufficient to return the frame from the nocking position to the storage position.

9. The invention of claim 8 wherein said angle of inclination is about 45°.

10. The invention of claim 6, 7, 8 or 9 wherein an arm interconnects the frame and the second end of the drive rod and locates the frame in the storage position and in the nocking position, the rotational movement of the drive rod being about 180° to move the arm and, consequently, the frame between the storage position and the nocking position, such that upon attachment of the mounting means to a bow having opposite sides, the frame will be moved from one to the other of the opposite sides of the bow.

11. The invention of claim 10 wherein the lever has opposite ends and includes a thumb bar at one of said opposite ends, the thumb bar being located for manual actuation of the lever from the rest position to the depressed position.

12. The invention of claim 10 including a latch at the other of the opposite ends of the lever, the latch engaging the arm when the lever is in the rest position and the frame is in the storage position to secure the frame in said storage position, the latch being disengagable from the arm in response to movement of the lever from the rest position toward the depressed position.

* * * * *